US012686904B2

(12) United States Patent
Ott et al.

(10) Patent No.: US 12,686,904 B2
(45) Date of Patent: Jul. 21, 2026

(54) AL—CE ALLOY BASED COMPOSITES

(71) Applicants: Iowa State University Research Foundation, Inc., Ames, IA (US); Lawrence Livermore National Security, LLC, Livermore, CA (US); UT-Battelle, LLC, Oak Ridge, TN (US); Eck Industries, Inc., Manitowoc, WI (US)

(72) Inventors: Ryan T. Ott, Ames, IA (US); Fanqiang Meng, Zhuhai (CN); Scott K. McCall, Livermore, CA (US); Hunter B. Henderson, Livermore, CA (US); Orlando Rios, Knoxville, TN (US); Zachary C. Sims, Knoxville, TN (US); David Weiss, Manitowoc, WI (US)

(73) Assignees: Iowa State University Research Foundation, Inc., Ames, IA (US); Lawrence Livermore National Security, LLC, Livermore, CA (US); UT-Battelle, LLC, Oak Ridge, TN (US); Eck Industries, Inc., Manitowoc, WI (US)

( * ) Notice: Subject to any disclaimer, the term of this patent is extended or adjusted under 35 U.S.C. 154(b) by 0 days.

(21) Appl. No.: 17/803,924

(22) Filed: Jan. 23, 2023

(65) Prior Publication Data

US 2023/0235432 A1 Jul. 27, 2023

Related U.S. Application Data

(60) Provisional application No. 63/361,907, filed on Jan. 26, 2022.

(51) Int. Cl.
*C22C 32/00* (2006.01)
*C22C 1/051* (2023.01)

(52) U.S. Cl.
CPC ..... *C22C 32/0036* (2013.01); *C22C 1/051* (2013.01); *C22C 32/0063* (2013.01)

(58) Field of Classification Search
CPC ..... C22C 32/0036
See application file for complete search history.

(56) References Cited

U.S. PATENT DOCUMENTS 4,379,719 A * 4/1983 Hildeman ..... C22C 1/0416 419/48
4,464,199 A * 8/1984 Hildeman ..... C22C 1/0416 419/60
5,296,190 A * 3/1994 Premkumar ..... C22F 1/04 420/528
9,963,770 B2 5/2018 Rios ..... 1/47
(Continued)

OTHER PUBLICATIONS

Bai et al., "Sliding wear of Al—Fe—Ce-SiC composites lubricated with several typical additives," Tribology Transactions. 1997, vol. 40, No. 2, pp. 267-272.*

(Continued)

*Primary Examiner* — Christopher S Kessler

(57) ABSTRACT

MMC's comprising an Al-RB alloy-based matrix and ceramic, metal and/or intermetallic reinforcement particulates dispersed in the alloy matrix provide improved strength and ductility wherein the reinforcement particulates have a higher melting temperature than the matrix alloy.

12 Claims, 5 Drawing Sheets

(56) References Cited

U.S. PATENT DOCUMENTS

| | | | | |
|---|---|---|---|---|
| 11,608,546 | B2 * | 3/2023 | Allard, Jr. | B22F 10/00 |
| 11,718,898 | B2 * | 8/2023 | Moore | C22C 21/02 428/570 |
| 2019/0040496 | A1 * | 2/2019 | Weiss | C22C 1/101 |
| 2021/0060652 | A1 * | 3/2021 | Rios | B33Y 40/20 |
| 2022/0380868 | A1 * | 12/2022 | Ott | B21C 29/003 |
| 2022/0380870 | A1 * | 12/2022 | Henderson | C22C 1/0416 |

OTHER PUBLICATIONS

Ramnath, B. Vijaya et al., Aluminum Metal Matrix Composites A Review, Rev. Adv. Mater. Sci. 38, 55-60, 2014 No. 7, 2010.
Amigo, V. et al., Comparison Between Ti3Al AND Ni3Al Intermetallics Used as Reinforcements in Aluminum Alloy MMCs, ICCM-12 Proceedings, paper 247, 1999.
Hunt, Jr., Warren H., Metal Matrix Composites, Advanced Materials & Processes, pp. 39-42, Feb. 2004.

* cited by examiner

AL—CE ALLOY BASED COMPOSITES

STATEMENT REGARDING FEDERALLY SPONSORED RESEARCH

This invention was made with government support under contract nos. DE-AC02-07CH11358; DE-AC05-00OR22725; and DE-AC52-07NA27344 awarded by the Department of Energy. The Government has certain rights in the invention.

FIELD OF THE INVENTION

The present invention relates to Al-RE (rare earth element) alloy-based metal matrix composites (MMC)'s containing reinforcement particulates in a manner to impart improved mechanical and/or physical properties to the material over a wide temperature range with or without optional post heat treatment processes.

BACKGROUND OF THE INVENTION

Certain aluminum alloys that include rare earth metals, such as Ce, La, and/or mischmetal (a mixture of different rare earth elements described in U.S. Pat. No. 9,963,770) are known and can be cast and optionally heat treated to exhibit excellent mechanical properties such as tensile strength and ductility at elevated temperatures as also described in U.S. Pat. No. 9,963,770. These cast or cast/heat treated aluminum-rare earth alloys (hereafter Al-RE alloys) have a multiphase microstructure that includes one or more intermetallic secondary phase (e.g. $Al_{11}X_3$ where X is the rare earth metal) in an aluminum-rich matrix. The intermetallic secondary phase(s) are present in a well-dispersed volume fraction in the form of a complex network of morphological phase features, such as lath features and/or rod features, in the aluminum-rich matrix in a manner that imparts excellent mechanical properties to the cast alloy. Since the intermetallic secondary phase(s) features are thermally stable at elevated temperatures, the cast alloy exhibits excellent mechanical properties over an extended temperature range.

This invention provides MMCs having an Al-RE alloy matrix and reinforcement particulates in the alloy matrix providing excellent mechanical properties, such as strength and ductility, desired physical properties (e.g., low coefficient of thermal expansion), and corrosion resistance over a wide temperature range without the need for post heat treatment processes commonly required for other classes of Al alloys.

SUMMARY OF THE INVENTION

In accordance with one aspect of the present invention, the foregoing and other objects are achieved by a metal matrix composite (MMC) comprising a relatively soft Al-RE alloy matrix containing relatively hard reinforcement particulates in the alloy matrix wherein the MMC exhibits excellent mechanical properties over a wide temperature range, being improved as compared to the same Al-RE alloy that is devoid of the relatively hard reinforcement particulates.

These MMC's are advantageous in that they can be cast, extruded, thermally sprayed, or additively manufactured with the reinforcement phase to achieve tailorable mechanical and physical properties that are stable over a wide-temperature range by adjusting the second-phase volume fraction, size, morphology, etc. Composites pursuant to certain aspects of the present invention can be made by methods that include, but are not limited to, melt processing, powder metallurgy, thermo-mechanical deformation (e.g. extrusion), thermal spray, cold spray, additive manufacturing such as 3D printing, and electrodeposition.

Moreover, the alloy matrix of the MMC's does not require any post synthesis heat treatment to obtain optimal strength or ductility or coefficient of thermal expansion (CTE) that can be tailored by adjusting the second-phase volume fraction, size, morphology, etc.

These and other objects and advantage associated with practice of aspects of the present invention will become readily apparent from the following drawings taken with the detailed description.

DETAILED DESCRIPTION OF THE INVENTION

Figure 1A:
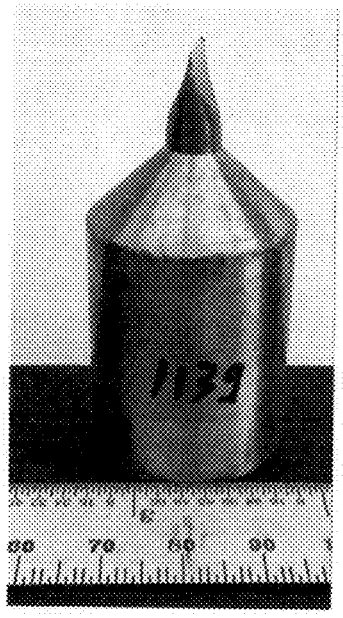
FIG. 1A shows a sealed copper can containing mixed powder for extrusion by the hot extrusion process (schematically shown FIG. 1B) and as described in Example 1.

A metal matrix composite (MMC) is provided comprising an Al-RE alloy matrix and reinforcement particulates dispersed in the alloy matrix wherein the reinforcement particulates have a higher melting temperature than the matrix alloy. Such MMC's exhibit excellent mechanical properties over a wide temperature range such as room temperature up to and above 230° C.

An illustrative MMC includes an aluminum-rare earth (Al-RE) alloy matrix that generally comprises about 1 to about 30 weight percent (hereafter: wt. %), preferably about 1 to about 20 wt. %, even more preferably about 1 to about 18 wt. %; and even further preferably about 1 to about 17 wt. % RE material where RE is selected from Ce, La, mischmetal, or any combination thereof, and balance aluminum (Al). The Al-RE alloy matrix can optionally include one or more additional alloying elements X that include at least one of Mg, Cu, Mn, Ca, Fe, Ni, Zr, Zn, Si and Ti in an amount of about 1 to about 14 wt. %. U.S. Pat. No. 9,963,770 describes such Al-RE alloys for use as the alloy matrix as well as natural mischmetal material as an optional source of RE for practice of certain aspects of the present invention, the entire disclosure of which patent is incorporated herein by reference to that end.

The Al-RE alloy matrix is formulated to include a relatively high weight percentage of a strengthening intermetallic $Al_{11}RE_3$ phase (or other intermetallic phases depending on alloy composition) in amounts from about 5 to about 30 wt. % of individual particles where RE is defined above. The alloy matrix is characterized as typically having a microstructure including the strengthening intermetallic $Al_{11}RE_3$ phase distributed in an aluminum-rich alloy matrix. The strengthening intermetallic $Al_{11}RE_3$ phase is characterized by being present in a relatively high phase fraction and by having closely spaced, fine lath microstructural features and/or rod microstructural features as well as fine lath spacing and is thermally stable as described in aforementioned U.S. Pat. No. 9,963,770.

A particular aspect of the present invention embodies a preferred composition wherein the Al content of the alloy matrix is controlled as represented by:

Al content=Al-(18-α wt %) LRE-α wt % X where α=total weight (wt)) % of additional alloying elements X between 1 to 12 weight % and where LRE=Ce, La, or Ce+La (i.e. LRE is Ce or La or both Ce and La).

Illustrative of such alloy matrix compositions include but are not limited to:

Al-16% Ce-2% Mg

Al-9% Ce-6% Cu-3% Mn

Al-8% Ce-10% Mg, where %'s are wt. %'s.

Certain aspects of the present invention include relatively hard reinforcement particulates in an amount of about 1 to about 40 volume % (or about 1 to about 50 weight %) of the MMC and can comprise ceramic, metal, and/or intermetallic reinforcement particulates of suitable shapes. As mentioned above, the reinforcement particulates have a higher melting temperature than the matrix alloy. Illustrative reinforcement particulates that can be used in practice of aspects of the present invention include, but are not limited to, $Al_2O_3$, $Ni_3Al$, $ZrO_2$, SiC, $B_4C$, REO such as $CeO_2$ and $La_2O_3$, YSZ, and others having a melting temperature higher than the matrix alloy.

In certain aspects of the present invention the reinforcement particulates have a minimum average dimension (such as minimum average diameter, length, sieve size, etc.) that is in the range of 0.01 microns to 250 microns. Although the Examples set forth below describe adding the reinforcement particulates ex situ (i.e. as an initial separate powder constituent together with a matrix alloy powder), the reinforcement particulates can be formed ex situ by adding the reinforcement particles to an alloy matrix melt or in situ in the alloy matrix by metallurgical reaction during composite processing methods described next.

Composites pursuant to certain aspects of the present invention can be made by methods that include, but are not limited to, melt processing, powder metallurgy, thermal-mechanical deformation (e.g. extrusion), thermal spray, cold spray, additive manufacturing such as 3D printing, and electrodeposition.

The following Examples are offered to further illustrate aspects of the present invention but not to limit the scope thereof.

Example 1

In Example 1, Al-8% Ce-10% Mg (all in wt %) powder that was commercially gas atomized was used to synthesize a series of MMC's via uniaxial extrusion. Two composites were prepared comprised of Al-8% Ce-10% Mg/$Al_2O_3$ and the Al-8% Ce-10% Mg/$Ni_3Al$. The $Al_2O_3$ and the $Ni_3Al$ reinforcement powders were obtained from commercial vendors.

Figure 1B:
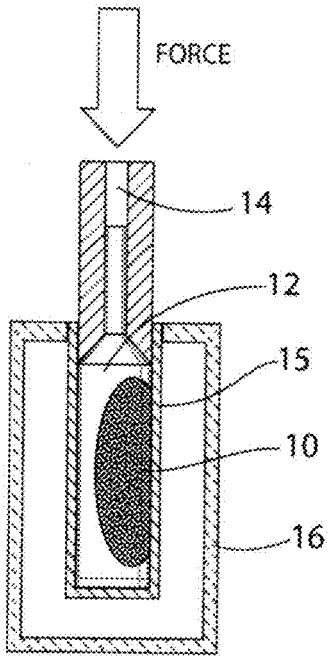
Figure 2:
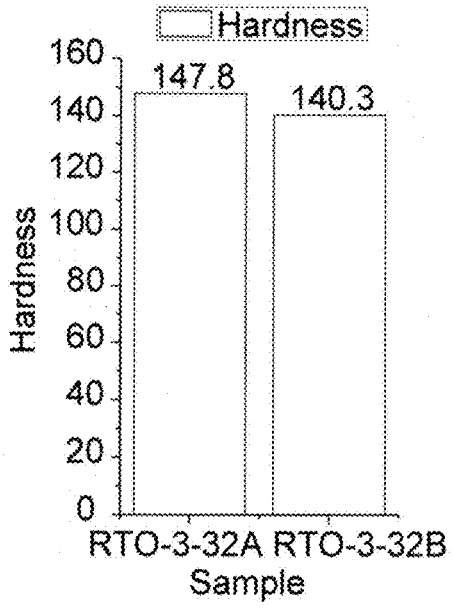
FIG. 2 is a bar graph showing the results of Vicker's hardness testing the MMC's prepared in Example 1 with two different reinforcing particles.
Figure 3A:
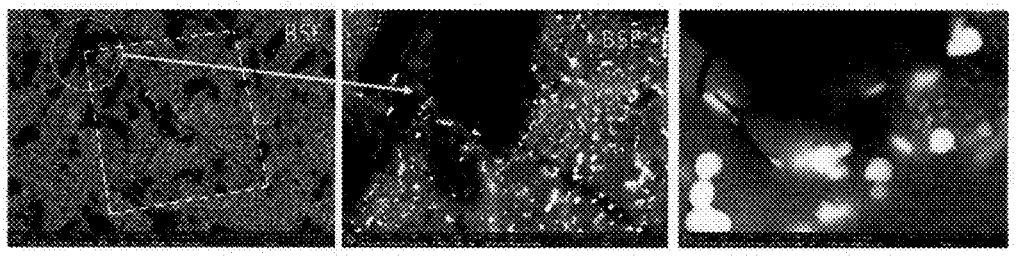
FIG. 3A are backscattered electron (BSE) images and FIG. 3B are SEM images of Al-8% Ce-10% Mg/$Al_2O_3$ MMC prepared in Example 1 after Vicker's hardness testing. The $Al_2O_3$ particles show cracking and fracturing from both extrusion process and hardness indentation, but no cracks are present at the particle/matrix interface, indicating good bonding there. The dashed boxes in the left views in FIGS. 3A and 3B delineate the boundaries of the measurement indentation.
Figure 3B:
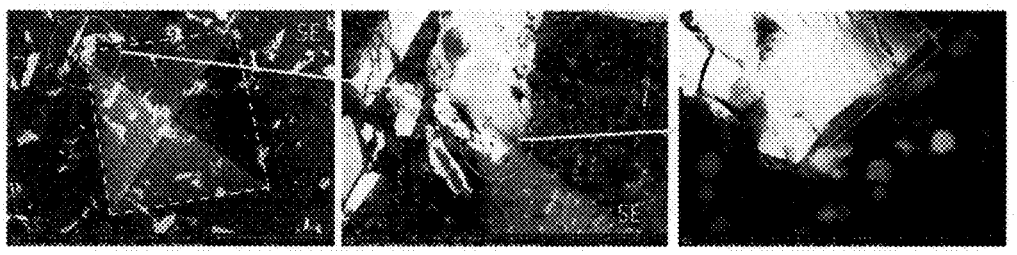

The Al-8% Ce-10% Mg powder (<53 microns particle size after sieving) was mixed with 15 wt % of $Ni_3Al$ (<45 microns particle size after sieving) and 20 wt % $Al_2O_3$ (<45 microns particle size after sieving), respectively. Each of the two mixtures of powders 10 was sealed under vacuum in respective Cu cans 12 with an outside diameter of 1.1 inches. Each can 12 placed in a support body 15 was uniaxially extruded through a 0.375 inch die opening 14 (extrusion ratio=9) at a temperature of 450° C. in extrusion furnace 16, FIG. 1B, to rod shape. After extrusion, the Vickers hardness of the different composites were tested as shown in FIG. 2. The microstructure of the $Al_2O_3$ reinforced composite after Vickers Hardness testing is shown in FIGS. 3A, 3B. While the ceramic reinforcement particles show clear cracking and fracturing from the indenter tip and possibly the extrusion process itself, no obvious cracking is seen at the interface. Moreover, the microstructure reveals that the $Al_{11}Ce_3$ particles in the surrounding alloy matrix have retained a small size despite the high (450° C.) extrusion temperature. These results highlight that the MMC's pursuant to practice of aspects of the present invention composites are advantageous for use in various aerospace, automotive, and other service applications.

Figure 4:
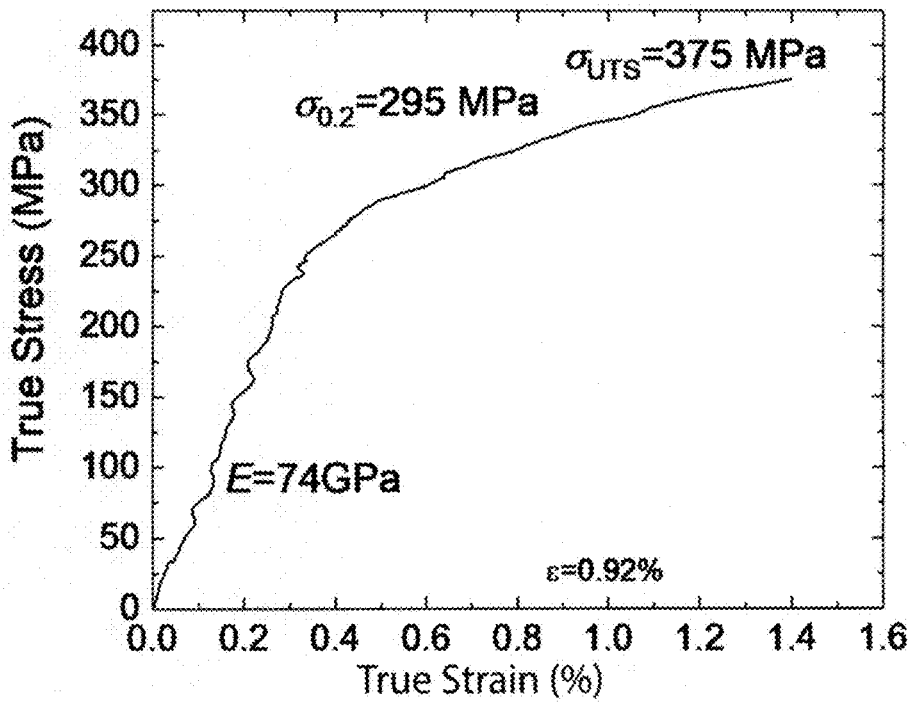
FIG. 4 is a graph of uniaxial tensile properties of the Al-8% Ce-10% Mg/$Al_2O_3$ MMC prepared in Example 1 at a strain rate of 5E-4$s^{-1}$ where strong work hardening behavior is observed together with ultimate tensile stress of 375 MPa and elastic modulus of 74 GPa.

The uniaxial tensile properties for the Al-8% Ce-10% Mg alloys reinforced with 20 wt % of $Al_2O_3$ particles is shown in FIG. 4. The composite shows strong work hardening behavior along with a small amount of plastic strain prior to failure. Since the $Al_2O_3$ particles used in this composite had a large size distribution range up to 45 μm and were irregular in morphology, it is expected that better mechanical performance can be achieved by tailoring the size and morphology of the second-phase particles along with the volume fraction.

Figure 5A:
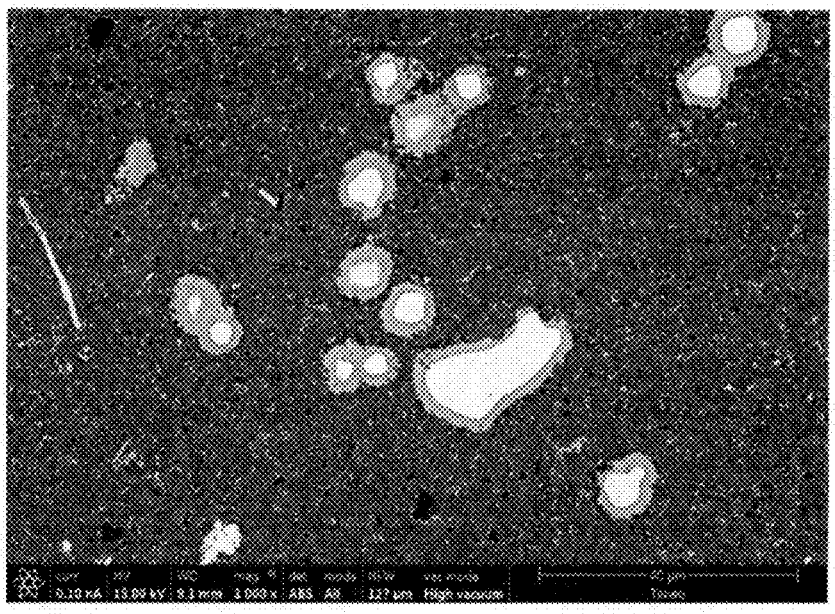
FIG. 5A is an SEM image (scanning electron microscopy) of the Al-8% Ce-10% Mg/$Ni_3Al$ MMC prepared in Example 1 showing an reaction layer between the particles and the alloy matrix after extrusion attributed to the Al-rich alloy matrix reacting with the Ni of the $Ni_3Al$ particles.
Figure 5B:
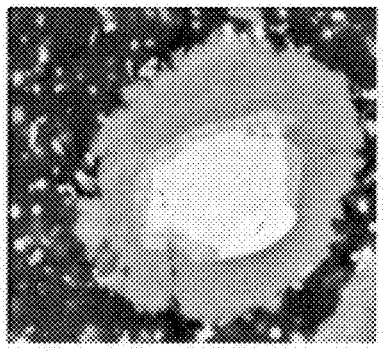
FIG. 5B is an enlarged SEM of a reinforcement particle of the MMC of Example 1.

The microstructure of the second phase reinforcement particles for the Al-8% Ce-10% Mg with 15 vol % $Ni_3Al$ is shown in FIGS. 5A, 5B. The reaction between the Ni in the particles in the Al in the matrix phase can be clearly seen at the interface, where a distinct interaction layer is formed. This creates a strong interface between the particles and the matrix, which helps partition the load between the two phases. As with the aforementioned extrusion containing the $Al_2O_3$ reinforcement particles, the mechanical properties of these composites can also be controlled by tailoring the size, volume fraction and morphology of the particles. Furthermore, the interface can be tailored by optimizing the processing conditions.

Example 2

In Example 2, Al-8% Ce-10% Mg powder that was commercially gas atomized as used to synthesize a MMC containing about 15 volume % SiC reinforcement particles via uniaxial extrusion using similar extrusion parameters as set forth in Example 1 other than use of a lower extrusion temperature of 350° C. The SiC reinforcement particles (10 micron size after sieving) were purchased from US Research Nanomaterials, Inc.

Figure 6A:
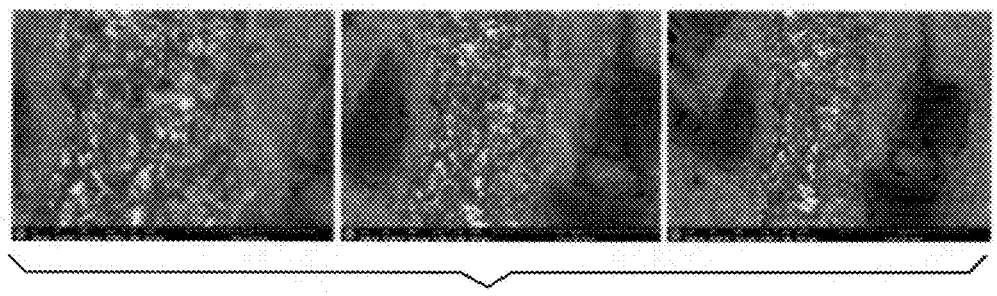
FIG. 6A are BSE images and FIG. 6B are SEM images of the extruded microstructure of the Al-8% Ce-10% Mg/SiC MMC prepared in Example 2 after extrusion.
Figure 6B:
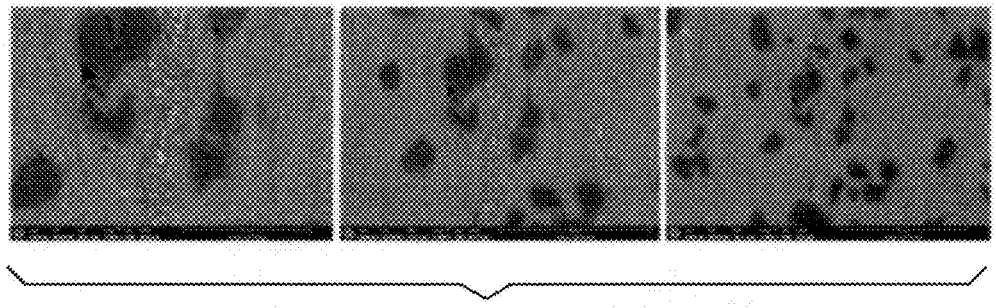

FIGS. 6A, 6B show BSE-SEM images (top row) and SE-SEM images (bottom row) of the extruded microstructure at various magnifications. The microstructure comprises the SiC particles (dark particles) dispersed in the alloy matrix. The relatively brighter bands of the extruded microstructure comprise regions of the Al—Ce—Mg powder that was larger in diameter than other particles, and thus, had coarser $Al_{11}Ce_3$ phase present. The extruded microstructure of these coarser powders is not as fine (smaller length-scale) as the rest of the matrix. The Vickers Hardness of the extruded samples was measured via 10 different measurements with an average value of 240.5.

Example 3

In Example 3, Al-8% Ce-10% Mg powder that was commercially gas atomized was used to synthesize a MMC containing about 20 weight % of $Al_2O_3$ particles using similar extrusion parameters as set forth in Example 1.

The measured Vicker's hardness of the MMC so produced was 159.4 as compared to the hardness values shown in FIG. 2 of the MMC's samples prepared in Example 1. The extruded samples were machined into sub-size dogbones for uniaxial tensile testing at a strain rate of $5\times10^{-4}$ $s^{-1}$. The measured ultimate tensile strength of the composite was about 375 MPa.

Example 4

Figure 7:
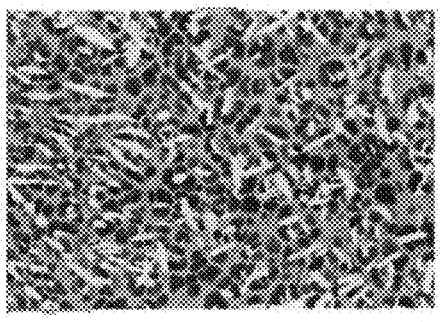
FIG. 7 is an SEM image of 3D printed Al—Ce—Mg+YSZ composite with the YSZ reinforcement particles (white phase) distributed in the alloy matrix.

In this Example, Al—Ce—Mg powders (45-125 microns size distribution) were blended with yttria-stabilized zirconia (YSZ) particles (45-125 microns) and the powder mixture printed using directed energy deposition (DED) additive manufacturing (AM) to provide printed Al—Ce—Mg+YSZ (yttria stabilized zirconia) composites. Referring to FIG. 7, the YZS reinforcement particles (white phase) are seen to be distributed in the Al—Ce—Mg alloy matrix of the composite. In this Example, the ceramic YSZ particles do not alloy with the matrix alloy, but rather provide distinct second-phase particles.

Moreover, the Al—Ce—Mg+YSZ composites can be made using both powder bed methods (e-beam or laser) as well as DED methods. The reinforcing phase can be a ceramic (YZS, SiC, $Al_2O_3$ and others) that has much higher melting temperature than Al—Ce matrix alloy.

Although aspects of the present invention have been described and shown with respect to certain illustrative embodiments, those skilled in the art will appreciate that the invention is not limited to these aspects and that changes and modifications can be made therein within the scope of the invention as set forth in the appended claims.

We claim:

1. A metal matrix composite comprising an alloy matrix that comprises consolidated alloy powder having a composition comprising Al, RE, and Mg and containing reinforcement particulates in the form of reinforcement powder particles dispersed in the alloy matrix wherein the reinforcement particulates have a higher melting temperature than the alloy matrix; wherein a metallic interfacial reaction layer is present between the alloy matrix and individual reinforcement particulates and includes constituent elements of the alloy matrix and of the reinforcement particulates, wherein presence of the interfacial reaction layer facilitates load partitioning between the relatively soft alloy matrix and relatively hard reinforcement particulates; wherein the metal matrix composite exhibits tensile strength greater than that of the alloy matrix devoid of the reinforcement particulates; and wherein the reinforcement particulates comprise powder particles of at least one of $Al_2O_3$, $Ni_3Al$, $ZrO_2$, SiC, $B_4C$, $CeO_2$, and/or $La_2O_3$.

2. The composite of claim 1 wherein the alloy matrix comprises about 1 to about 30 weight % RE material where RE material is selected from Ce, La, mischmetal, or any combination thereof, and balance aluminum (Al).

3. The composite of claim 2 wherein the alloy matrix comprises about 1 to about 20 weight % RE material.

4. The composite of claim 3 wherein the alloy matrix comprises about 1 to about 18 weight % RE material.

5. The composite of claim 2 wherein the alloy matrix comprises at least one alloying element selected from the group consisting of Mg, Cu, Mn, Ca, Ni, Zr, Zn, Si, and Ti in a total amount of about 1 to about 14 weight %.

6. The composite of claim 1 wherein the reinforcement powder particles are present in the alloy matrix in an amount of about 1 to about 40 volume %.

7. The composite of claim 1 wherein the reinforcement powder particles are sieved to have an as-sieved minimum average diameter that is in the range of 0.01 microns to 250 microns.

8. The composite of claim 1 which is at least one of an extruded composite, thermal sprayed composite, cold sprayed composite, additive manufactured composite, or electrodeposited composite.

9. The composite of claim 1 wherein the alloy matrix comprises Mg alloying element present in a total amount of 1 to 12 weight % and a light rare earth element comprising at least one of Ce, or La, or both Ce and La in an amount of 18 weight % minus the weight % of the Mg alloying element.

10. The composite of claim 1 wherein the interfacial reaction layer surrounds individual reinforcement particulates.

11. The composite of claim 1 wherein the interfacial reaction layer is present as a physically distinct layer from the alloy matrix.

12. A metal matrix composite comprising a Al-RE alloy matrix that comprises consolidated alloy powder having a composition comprising Al and RE and containing reinforcement particulates consisting of reinforcement powder particles in the alloy matrix wherein the reinforcement powder particles have a higher melting temperature than the alloy matrix; wherein a metallic interfacial reaction layer is present between the alloy matrix and the reinforcement particulates and includes constituent elements of the alloy matrix and of the reinforcement particulates wherein presence of the interfacial reaction layer facilitates load partitioning between the relatively soft alloy matrix and relatively hard reinforcement particulates; wherein the metal matrix composite exhibits tensile strength for load bearing greater than that of the alloy matrix devoid of the reinforcement powder particles, wherein the reinforcement powder particles are selected from $Al_2O_3$, $Ni_3Al$, $ZrO_2$, SiC, $B_4C$, $CeO_2$, or $La_2O_3$, and wherein the consolidated alloy powder forming the matrix comprises at least one additional alloying element selected from Mg, Cu and/or Mn.

* * * * *